US006722802B2

(12) United States Patent
Teo et al.

(10) Patent No.: US 6,722,802 B2
(45) Date of Patent: Apr. 20, 2004

(54) WET PRINTED MEDIA OUTPUT SYSTEM

(75) Inventors: Cherng Linn Teo, Singapore (SG); Keng San Chia, Singapore (SG); Tzy Woei Chu, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/209,605

(22) Filed: Jul. 30, 2002

(65) Prior Publication Data

US 2004/0020385 A1 Feb. 5, 2004

(51) Int. Cl.[7] ..... B41J 13/10; B41F 3/52
(52) U.S. Cl. ..... 400/718; 400/625; 101/417
(58) Field of Search ..... 400/625, 638, 400/6, 46, 647, 679, 717, 718; 347/4, 101, 102, 104, 215; 271/188, 189, 207, 209, 306; 101/416.1, 417, 419

(56) References Cited

U.S. PATENT DOCUMENTS 4,870,432 A * 9/1989 Maeda et al. ..... 347/66
5,523,848 A * 6/1996 Musso et al. ..... 358/296
5,738,454 A * 4/1998 Zepeda et al. ..... 400/625
6,042,106 A * 3/2000 Kelly et al. ..... 271/188
6,089,772 A * 7/2000 Takemura et al. ..... 400/625
6,148,727 A * 11/2000 Parthasarathy et al. ..... 101/417

* cited by examiner

*Primary Examiner*—Andrew H. Hirshfeld
*Assistant Examiner*—Hoai-An D. Nguyen

(57) ABSTRACT

A wet printed media output system in a printing mechanism including a frame is provided. The system includes an election mechanism mounted to the frame for ejecting a wet printed medium along a media path in an output direction towards an output area and a holding member mounted to the frame adjacent to the ejection mechanism. A portion of the holding member projects out of the media path at an angle to a plane defined by the output direction and a trailing edge of the medium for deviating at least a portion of the printed medium from the output direction. Furthermore, the angle is adjustable in correspondence with a character of the printed medium.

5 Claims, 4 Drawing Sheets

WET PRINTED MEDIA OUTPUT SYSTEM

BACKGROUND

This invention relates to technologies for managing wet printed media output in printing mechanisms.

In certain types of printing mechanisms such as inkjet printers, a printed media sheet may remain wet for a period after images have been imprinted on it. It is generally desired that such a wet printout be dried before it is ejected onto an output tray to avoid possible smearing of the images on the previously ejected media sheets. Holding members such as ramps and wing structures are commonly used to hold the wet printed media sheet for a desired distance before the printed media sheet moves onto the output tray.

FIG. 1 illustrates such a pair of wings 101 in an inkjet printer. The wings 101 are mounted to the printer frame 103 at two sides of the printer along the media width and positioned in front of the output roller 105 in the output direction as indicated by arrow 111, in which the output roller 105 propels the printed media sheet 107 into an output area 109. The wings 101 project upward at an angle and accordingly lift up two sides of the printed media sheet 107. As a result, the front portion of the media sheet 107 that has passed the output roller 105 is curled upwards. Such a change of shape allows the media sheet 107 to sustain itself for some desired distance before it falls onto the output tray (not shown) on its own weight. Furthermore, the shape change of the media sheet 107 also creates a stress on the media sheet 107.

However, the stress causes a retarding force on the media sheet opposite to its forward motion along the output direction. Such a retarding force may affect the linefeed accuracy of the media sheet. Especially, when the media sheet has just met the wings, the sudden change in the stress and consequently the sudden change in the retarding force may cause a jerking effect on the media advancement, which may affect the linefeed of the media sheet. Generally, the larger amount of the stress on the media sheet, the larger amount of the retarding force is caused, and the more significantly the linefeed accuracy can be affected.

The stress is affected by both the shape change and the stiffness of the media sheet 107; the stiffness of the media sheet 107 can be affected by its material, thickness, width and so on. Conventionally, the wings 101 are rigidly mounted to the printer frame 103, and therefore the amount of the shape change remains almost identical regardless of the variation in the stiffness of the media sheet. Consequently, the stress on the media sheet 107 varies corresponding to the variation in the stiffness of the media sheet 107. In particular, the stiffer the media sheet, the larger amount of stress is exerted on the media sheet In the conventional designs, the wings are oriented based upon media having a relatively small amount of stiffness so that most types of media can be held for at least a desired distance during the ejection. However, when a stiffer media sheet is used, a larger amount of stress more than necessary Is caused. Such a larger amount of stress may not be desirable in that it may affect the linefeed accuracy of the media sheet significantly.

Modifications have been made to optimize such a stress on the media sheet of various stiffness. For example, retractable holding members disclosed in U.S. Pat. No. 6,148,727, entitled "Wet Printed Media Output Mechanism System" and assigned to the current assignee, Hewlett-Packard Company, CA, can be used to at least partially solve the problem. However, such a mechanism requires relatively complicated synchronization between the movements of the holding members and other parts of the output system.

Therefore, them is a need for a convenient way of optimizing the stress on the printed media sheet exerted by the holding members of a wet printed media output system in a printing mechanism.

SUMMARY

According to an aspect of the present invention, there is provided a wet printed media output system in a printing mechanism including a frame. The system includes an ejection mechanism mounted to the frame for ejecting a wet printed medium along a media path in an output direction towards an output area and a holding member mounted to the frame adjacent to the ejection mechanism. A portion of the holding member projects out of the media path at an angle to a plane defined by the output direction and a trailing edge of the medium for deviating at least a portion of the printed medium from the output direction. Furthermore, the angle is adjustable in correspondence with a character of the printed medium.

According to another aspect of the present invention, in a method for ejecting a wet printed medium in a printing mechanism having a frame, an ejection mechanism mounted to the frame for ejecting the medium along a media path in an output direction towards an output area is provided. Furthermore, a holding member is mounted to the frame adjacent to the ejection mechanism, and a portion of the holding member projects out of the media path at an angle to a plane defined by the output direction and a trailing edge of the medium for deviating at least a portion of the printed medium from the output direction. During the ejection process, the angle is adjusted in correspondence with a character of the printed medium for optimizing a stress on the medium exerted by the holding member.

Other aspects and advantages of the invention will become apparent from the following detailed description in conjunction with the accompanying drawings; the description Illustrates by way of example the principles of the invention.

DETAILED DESCRIPTION

Figure 1:
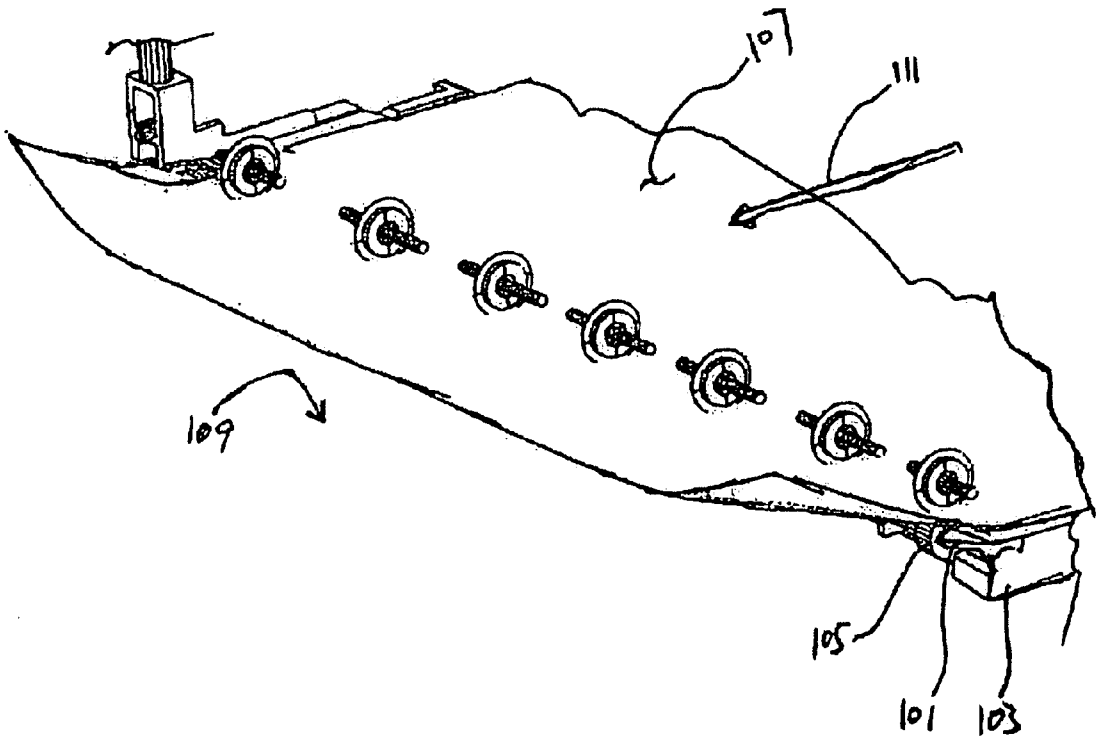
Fig 1 (Prior art)
FIG. 1 illustrates a conventional wet printed media output mechanism in a printer having a pair of wings rigidly fixed to the printer frame.
Figure 2:
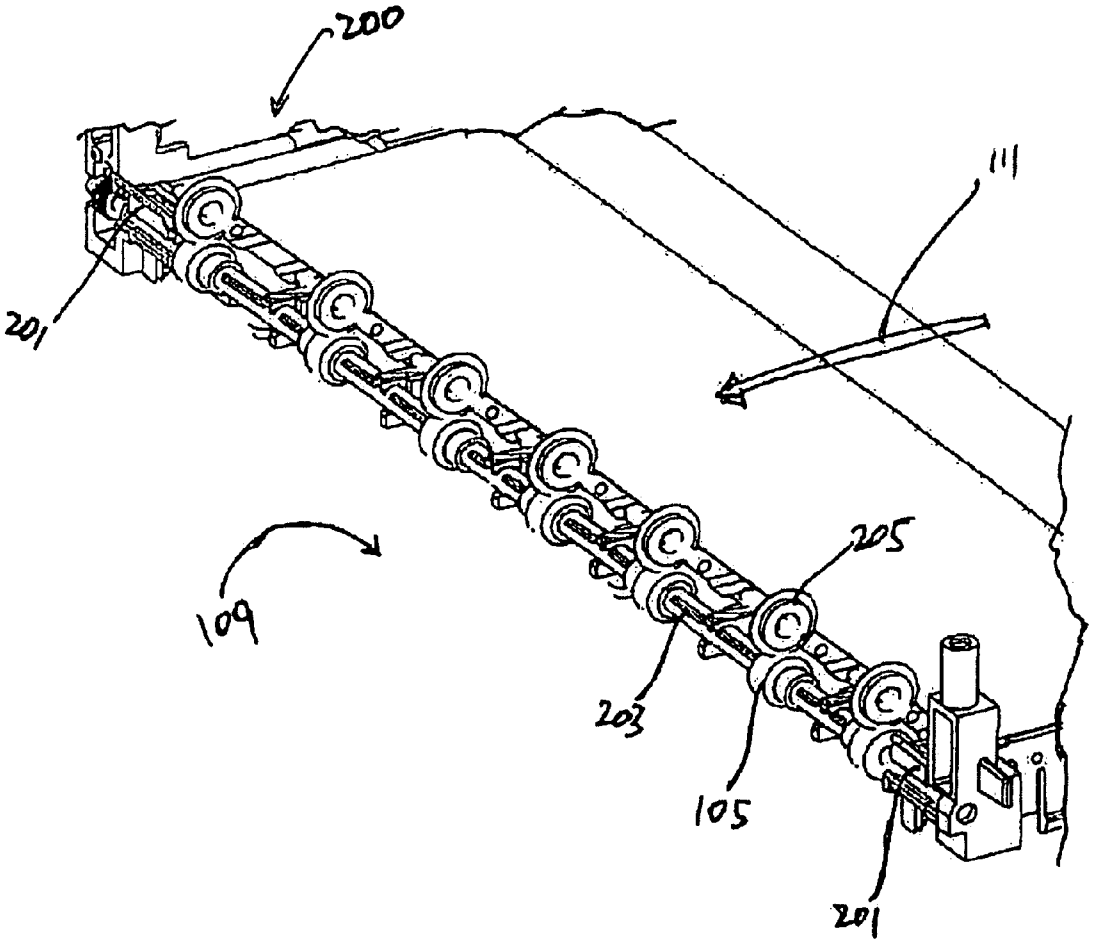
FIG. 2 illustrates an exemplary wet printed media output system according to the present invention.

Illustrated in FIG. 2 is an exemplary wet printed output system 200 of an exemplary inkjet printer (not shown). The output system 200 has a plurality of output rollers 105 rotatably mounted to an output roller shaft 203 between the output area 109 and the print zone (not shown) where the media sheet (not shown in FIG. 2) receives inks during printing operations. These output rollers 105 work in cooperation with their respective starwheels 205 to propel the printed media sheet (not shown in FIG. 2) along the media path in the output direction 111 towards the output area 109. A pair of adjustable wings 201 are rotatably mounted to the output roller shaft 203 at two sides of the output roller along the media width, which is substantially perpendicular to the output direction 111.

Figure 3:
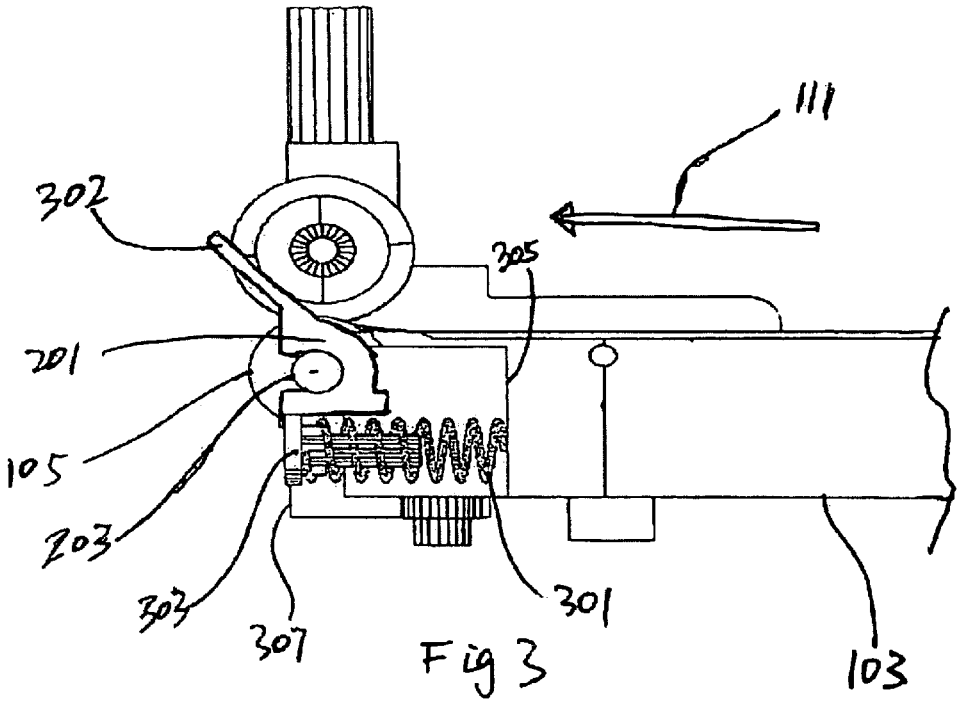
FIGS. 3 and 4 are side views of a portion of the output system of FIG. 2, illustrating the operation of the holding members.
Figure 4:
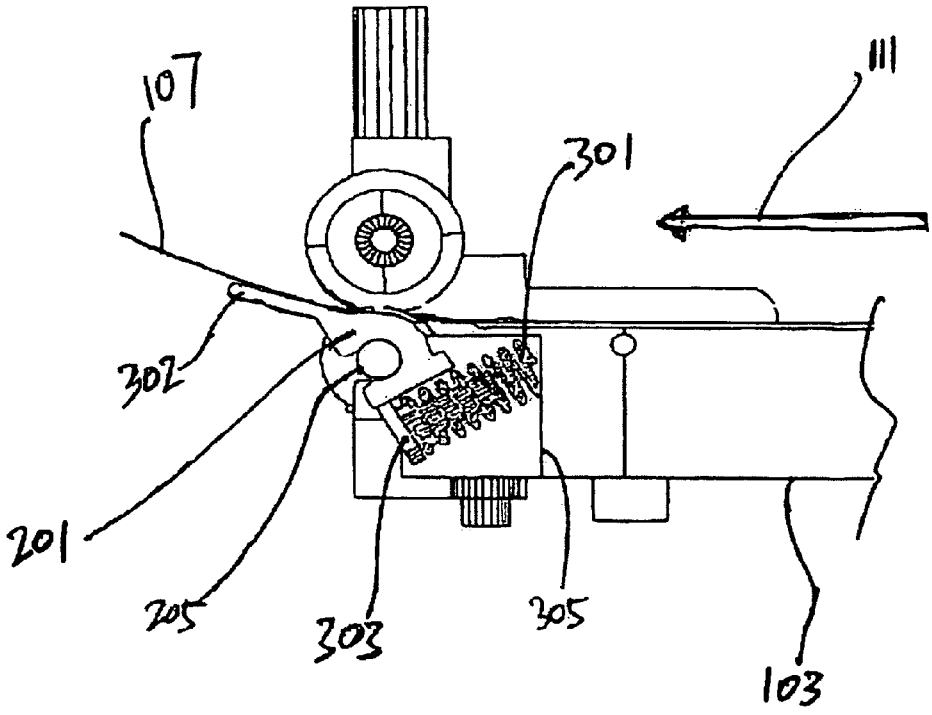

As shown in FIGS. 3 and 4, each wing 201 is divided into an upper portion 302 and a lower portion 303 by the output roller shaft 203. Each upper portion 302 is above the output roller shaft 203, projects out of the media path at an angle to a plane defined by the output direction and the trailing edge (not shown) of the media sheet 107 for deviating at least a portion of the printed medium from the output direction. In particular, the upper portions lift up at least a portion of the printed media sheet 107 (see FIG. 4) when the media sheet is advanced to the output area 109 for sustaining the media sheet for some desired distance before it fails onto the output tray (not shown) on its own weight. Each lower portion is under the output roller shaft 203 and is connected to an end of a compression spring 301; the other end of each spring is freely slidable along a back wall 305. The back wall 305 is mounted to part of the printer frame 103 and extends downward. Being compressed, each compression spring 301 biases its respective lower portion 303 towards a front wall 307, which is also mounted to the printer frame 103 and is preferably substantially parallel to the back wall 305.

When the output system is not in operation, that is, when no media sheet is being advanced to the output area, the lower portion 303 is biased against the front wall 307 and is thus prevented from further moving forward. In that case, the upper portion 302 is in its reset position and extends at its steepest angle as shown in FIG. 3.

When a printed media sheet 107 Is advanced by the output roller 105 toward the output area 109 and when its front part has passed the output roller 105 as shown in FIG. 4, the media sheet reaches the front portions 302 of the wings. The wings 201 lift up the front part of the media sheet 107 that has passed the output roller 105 and exert a stress on the media sheet 107. Accordingly, the media sheet 107 applies a pressure force, which is of the same amount of the stress force on the media sheet, and consequently a torque to the front portions 302 of the wings 201. When such a torque exceeds the torque to the lower portion 303 applied by the compression springs 301, the wings 201 rotate about the output roller shaft in a way so that the front portions 302 rotate downward and the lower portions 303 rotate upward.

When each lower portion 303 of the wings rotates upward, its respective compression spring 301 is further compressed and consequently applies an increased biasing force on the lower portion 302. Accordingly, the torque to each lower portion 303 by its respective compression spring 303 is increased. When the torques applied to each upper portion 302 and the on to its respective lower portion are balanced, the rotation of the wings stops.

The angle at which the media sheet extends is decided by the characteristics of the compression spring and the pressure on the upper portions by the media sheet, where the pressure is of the same amount as the stress on the media sheet exerted by the wings. As discussed above, if the wings are rigidly mounted to the printer frame, the amount of the stress on a stiffer media sheet is larger than the one on a normal and less stiff media sheet. Therefore, when a stiffer media sheet is used in the exemplary embodiment, the upper portions of the wing are pressed further downward so that the compression spring is compressed by a larger amount to balance the larger amount of pressure on the upper portions, as compared to the situation when a normal media sheet is used. As a result, the upper portions extend at a smaller angle when a stiffer media sheet is used, as compared to the case when a normal media sheet is used. By pre-selecting suitable compression springs, the angle at which the wings extend can be adjusted to a desire degree in correspondence to the stiffness of the media sheet In this way, the stress on the media sheet is optimized.

Alterative can be made to the exemplary embodiment. For example, ramps can be used to replace the wings. Also, an additional shaft mounted to the frame, rather than the output roller shaft, can be used to mount the wings. Besides, different types of springs can be used instead of compression springs. Furthermore, the springs can be eliminated if the wings am rotatably mounted to a stationary shaft and if the friction force between the wings and the shaft Is high enough to sustain the angle at which the wings extend. In that case, when media sheets of different stiffness are used, the user manually rotates the wings to overcome the friction force and to adjust the angle at which the wings extend.

In addition, in the exemplary embodiment, the wings are rotatable about a shaft substantially parallel to the leading or trailing edge of the media sheet 107. However, it is understood that the applied Invention can also be used in a media output system, where the wings are rotatable about a shaft substantially parallel to the side edges of the media sheet. In that case, the wings rotate in a plane substantially perpendicular to the output direction 111.

What is claimed is:

1. A wet printed media output system in a printing mechanism including a frame, the system comprising:

an ejection mechanism mounted to the frame for ejecting a wet printed medium along a media path in an output direction towards an output area; and a holding member mounted to the frame adjacent to the ejection mechanism and above the output area for temporarily holding the media before the printed medium is ejected into the output area, a portion of the holding member projecting out of the media path at an angle to a plane defined by the output direction and a trailing edge of the medium for deviating at least a portion of the printed medium from the output direction, wherein said angle is adjustable in correspondence with stiffness of the printed medium such that a stress exerted on the printed medium by the holding member can be adjusted.

2. The system of claim 1, wherein the holding member is rotatably mounted to the frame so that said angle is adjustable.

3. The system of claim 1, wherein said angle is automatically adjusted through interaction between the holding member and the printed medium being ejected.

4. The system of claim 3, further comprising a supporting mechanism connected to the holding member for providing a balancing force to the holding member so that said angle is adjusted to a desired degree.

5. The system of claim 4, wherein the supporting mechanism included a spring with one end mounted to the holding member while the other end coupled to the frame for providing a biasing force to the holding member.

* * * * *